US010550789B2

(12) United States Patent
Yim

(10) Patent No.: US 10,550,789 B2
(45) Date of Patent: Feb. 4, 2020

(54) METHOD OF CONTROLLING FUEL INJECTION QUANTITY USING LAMBDA SENSOR AND VEHICLE TO WHICH THE SAME IS APPLIED

(71) Applicant: Hyundai Motor Company, Seoul (KR)

(72) Inventor: Sung-Soon Yim, Gunpo-si (KR)

(73) Assignee: Hyundai Motor Company, Seoul (KR)

( * ) Notice: Subject to any disclaimer, the term of this patent is extended or adjusted under 35 U.S.C. 154(b) by 266 days.

(21) Appl. No.: 15/380,684

(22) Filed: Dec. 15, 2016

(65) Prior Publication Data

US 2018/0058362 A1 Mar. 1, 2018

(30) Foreign Application Priority Data

Aug. 23, 2016 (KR) ..... 10-2016-0106741

(51) Int. Cl.
*F02D 41/24* (2006.01)
*F02D 41/14* (2006.01)

(52) U.S. Cl.
CPC ..... *F02D 41/2467* (2013.01); *F02D 41/1402* (2013.01); *F02D 41/1454* (2013.01); *F02D 2041/1409* (2013.01); *F02D 2200/101* (2013.01)

(58) Field of Classification Search
CPC ..... F02D 41/2467; F02D 41/1402; F02D 41/1454; F02D 41/1482; F02D 41/1483; F02D 41/2454; F02D 2041/1409; F02D 2200/101; F02D 41/2445; F02D 41/248; F02D 41/2416; F02D 41/2441; F02D 41/2461; F02D 41/1486; F02D 41/2438;
(Continued)

(56) References Cited

U.S. PATENT DOCUMENTS 4,655,188 A * 4/1987 Tomisawa ..... F02D 41/2454 123/674
4,729,359 A * 3/1988 Tomisawa ..... F02D 31/003 123/339.12
(Continued)

FOREIGN PATENT DOCUMENTS

JP H10-212993 A 8/1998
JP 2843385 B2 1/1999
(Continued)

*Primary Examiner* — David Hamaoui
*Assistant Examiner* — John D Bailey
(74) *Attorney, Agent, or Firm* — Morgan, Lewis & Bockius LLP

(57) ABSTRACT

A method of controlling a fuel injection quantity using a lambda sensor may include performing a lambda deviation learning mode by controlling a lambda deviation, due to a difference between a lambda model value and a lambda sensor measurement value, by a controller during engine combustion in which an engine RPM and a fuel injection quantity are detected, wherein, in the lambda deviation learning mode, a learning map is learned and is then updated by setting a fuel correction quantity depending on the lambda deviation as a learning value, and a fuel injection quantity is determined, in consideration of the fuel correction quantity depending on an RPM and a fuel quantity based on the updated learning map, and is output as an output value, so that the output value is applied to feedback control for a next fuel injection quantity.

13 Claims, 6 Drawing Sheets

(58) Field of Classification Search
CPC ..... F02D 41/2477; F02D 41/2422; F01N 2560/025; F01N 2560/02; F01N 11/007; F23N 2025/30; F02B 77/086; B60W 2510/0619
USPC ..... 123/674, 339.12, 703, 704, 406.45, 672, 123/673, 679, 694, 696, 339.21, 438; 73/114.45, 114.72, 114.73; 701/102, 109, 701/103, 104
See application file for complete search history.

(56) References Cited

U.S. PATENT DOCUMENTS 4,800,857 A * 1/1989 Tomisawa ..... F02D 41/2454 123/674
4,850,326 A * 7/1989 Tomisawa ..... F02D 41/2454 123/675
4,854,287 A * 8/1989 Tomisawa ..... F02D 41/2445 123/675
4,924,836 A * 5/1990 Uchida ..... F02D 41/2441 123/674
4,977,881 A * 12/1990 Abe ..... F02D 41/0042 123/520
5,150,301 A * 9/1992 Kashiwabara ..... F02D 41/2454 123/1 A
5,224,461 A * 7/1993 Nakaniwa ..... F02D 41/1495 123/688
5,227,975 A * 7/1993 Nakaniwa ..... F02D 41/1483 123/693
5,243,951 A * 9/1993 Nakaniwa ..... F02D 41/1454 123/674
5,251,437 A * 10/1993 Furuya ..... F02D 41/1441 123/674
5,297,046 A * 3/1994 Nakaniwa ..... F02D 41/248 123/674
5,299,550 A * 4/1994 Inoue ..... F02D 41/22 123/674
5,419,302 A * 5/1995 Abe ..... F02D 41/0042 123/674
5,447,137 A * 9/1995 Asano ..... F02D 41/1475 123/436
5,622,047 A * 4/1997 Yamashita ..... F01N 11/007 60/274
5,758,490 A * 6/1998 Maki ..... F02D 41/008 123/674
5,797,369 A * 8/1998 Suzuki ..... F02D 41/008 123/436
5,806,306 A * 9/1998 Okamoto ..... F01N 11/007 60/277
5,884,613 A * 3/1999 Kitamura ..... F02D 41/1402 123/696
6,244,241 B1 * 6/2001 Mamiya ..... F02D 41/2461 123/295
7,813,867 B2 * 10/2010 Yasui ..... F02D 41/1403 123/688
2002/0170291 A1 * 11/2002 Shirakawa ..... F02B 37/22 60/602
2007/0169464 A1 * 7/2007 Saito ..... F02D 41/1438 60/276
2010/0168986 A1 * 7/2010 Iwazaki ..... F02D 41/0085 701/103
2010/0217506 A1 * 8/2010 Mizoguchi ..... F01N 11/007 701/109
2013/0218442 A1 * 8/2013 Miyaji ..... F02D 41/1454 701/108
2014/0090627 A1 * 4/2014 Nagasawa ..... F02D 41/2448 123/568.21
2016/0258376 A1 * 9/2016 Jammoussi ..... F02D 41/123
2017/0314499 A1 * 11/2017 Urano ..... F02D 41/1475
2017/0356363 A1 * 12/2017 Jammoussi ..... F02D 41/0085

FOREIGN PATENT DOCUMENTS

JP H 11-294230 A 10/1999
JP 2006-258037 A 9/2006
KR 10-2008-0032730 A 4/2008

* cited by examiner

METHOD OF CONTROLLING FUEL INJECTION QUANTITY USING LAMBDA SENSOR AND VEHICLE TO WHICH THE SAME IS APPLIED

CROSS-REFERENCE TO RELATED APPLICATIONS

The present application claims priority to Korean Patent Application No. 10-2016-0106741, filed on Aug. 23, 2016, the entire contents of which is incorporated herein for all purposes by this reference.

BACKGROUND OF THE INVENTION

Field of the Invention

Exemplary embodiments of the present invention relate to a method of controlling a fuel injection quantity; and, particularly, to a vehicle to which a method of controlling a fuel injection quantity using a lambda sensor is applied.

Description of Related Art

In general, the quantity of fuel injected into an engine in a diesel vehicle is controlled based on lambda (λ) as an air excess ratio (a ratio between the volume of air actually supplied and the volume of air required to completely burn fuel), the value of which is 1 in a theoretical air-fuel ratio at which fuel is completely burned.

To this end, an air volume sensor for detecting an intake air volume is mounted in an intake system through which a mixture is supplied to an engine, and a lambda sensor (or an oxygen sensor) for measuring an oxygen concentration in exhaust gas is mounted in an exhaust system through which exhaust gas is discharged out of an engine.

For example, when the engine is driven, the lambda sensor and the air volume sensor detect an air volume in the intake system and an oxygen concentration in the exhaust gas, respectively, and the detected values are provided as input data of an engine Electronic Control Unit (ECU). The engine ECU corrects the volume of air, which will be transferred to the intake system, using the oxygen concentration detected by the lambda sensor, and then corrects a fuel quantity based on the corrected air volume, thereby controlling engine combustion such that the calculated fuel injection quantity coincides with the actual fuel injection quantity.

As a result, it is possible to reduce exhaust harmful substances and improve power and fuel efficiency together by controlling a fuel injection quantity to eliminate or reduce a difference between the calculated value thereof and the actual value thereof in the diesel vehicle.

However, when the values measured by the lambda sensor and the air volume sensor are applied to the calculation of a fuel injection quantity without the correction of the values, the calculated fuel injection quantity may not be reflected in an influence on the measured values by the manufacturing deviations and service errors of the sensors themselves.

As a result, although the calculated fuel injection quantity is based on the measured value of the lambda sensor, a quantity of fuel which is actually injected (hereinafter, referred to as an "actual fuel injection quantity") differs from the calculated fuel injection quantity, thereby, due to the difference between these values, deteriorating engine power and fuel efficiency and increasing harmful substances in exhaust gas.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method of controlling a fuel injection quantity using a lambda sensor, which determines an error in the measured value of a lambda sensor as a lambda deviation using a lambda model forming an engine combustion model, updates an RPM (Revolutions Per Minute) and fuel quantity learning map by learning a fuel correction quantity corresponding to the lambda deviation in the learning map, and then determines a fuel injection quantity using the updated learning map so that the determined fuel injection quantity coincides with an actual fuel injection quantity, and which is configured for controlling combustion to maintain robustness against surrounding environmental errors and service errors as well as the sensor itself by consistently learning a fuel correction quantity, output depending on an engine RPM and a fuel quantity, by feedback control in the next injection, and a vehicle to which a same is applied.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a method of controlling a fuel injection quantity using a lambda sensor includes checking whether an engine RPM and a fuel quantity are greater than a set value to determine engine combustion, detecting a lambda sensor measurement value when the engine combustion is performed, reading a lambda mode value of a lambda model corresponding to the lambda sensor measurement value so as to check a lambda deviation when the difference between the lambda model value and the lambda sensor measurement value is greater than "0", converting the lambda deviation output through PID control into the fuel correction quantity, learning the lambda deviation such that a bin cell is divided into four points surrounding one point, to which the fuel correction quantity is input, by a histogram of oriented gradient in the learning map, and bin values of the four divided points are determined as two-dimensional coordinate values to update the learning map, and determining a lambda deviation fuel injection quantity such that the bin values of the four points of the bin cell are obtained as two-dimensional coordinate values according to an operating section by a bilinear interpolation in the updated learning map, and one point surrounded by the four points is output as the output value.

The learning the lambda deviation may be performed by determining an index such that an associated section of the learning map, in which the one point is present, is determined, by performing normalization for an RPM and a fuel quantity in the associated section, by determining a bin value of each of the four points, by determining a bin are configured to which the bin value of each of the four points is applied, and by learning and updating the learning map using a determined value of the bin function.

The determining a lambda deviation fuel injection quantity may be performed by determining an index such that the index is divided into an RPM index and a fuel quantity index to determine whether the bin cell, to which a bin value of each of the four points is input, is present in which of RPM and fuel quantity sections of the learning map, by invoking the bin value of each of the four points as a peripheral array value, by performing normalization such that the RPM index and the fuel quantity index are converted into a reference RPM index and a reference fuel quantity index, and by performing calculation such that a value of the one point is obtained as the output value by applying the reference RPM index and the reference fuel quantity index to the four points.

When the lambda deviation is not generated, a lambda deviation non-learning mode may be performed by control of the controller, and in the lambda deviation non-learning mode, a fuel injection quantity may be determined, in consideration of the lambda sensor measurement value depending on an RPM and a fuel quantity based on the learning map, and be output as an output value, so that the output value is applied to feedback control for a next fuel injection quantity.

In accordance with another embodiment of the present invention, a system for controlling a fuel injection quantity includes a sensor measurement unit configured to detect a measured value of a lambda sensor provided in an exhaust system from which exhaust gas is discharged to an outside, a lambda deviation determination unit configured to determine a lambda deviation by comparing the lambda sensor measurement value with a lambda model value and to determine a fuel correction quantity by outputting the determined lambda deviation through PID control, and a learning controller configured to learn an RPM and a fuel quantity using the fuel correction quantity by a histogram of oriented gradient, to determine a learning value as an output value corresponding to the fuel correction quantity by a bilinear interpolation depending on an RPM and a fuel quantity in an operating section to which the learning value is applied, and then to apply the output value to feedback control for a next fuel injection quantity.

The lambda deviation determination unit may include a lambda model in which a lambda model value compared with the lambda sensor measurement value is established, a PID governor to output a lambda deviation value, obtained by subtracting the lambda model value from the lambda sensor measurement value, through PID control, and a converter to determine a fuel injection quantity output through the PID control. The learning controller may include a learning map configured to divide the operating section into an RPM section and a fuel quantity section and to be updated by learning the learning value, and the learning map may include a learning machine to perform the histogram of oriented gradient and a calculator to perform the bilinear interpolation.

In accordance with a further embodiment of the present invention, the vehicle includes a system for controlling a fuel injection quantity including a sensor measurement unit configured to detect a measured value of a lambda sensor provided in an exhaust system from which exhaust gas is discharged to an outside, a lambda deviation determination unit configured to determine a fuel correction quantity by outputting a lambda deviation determined through a lambda model compared with the lambda sensor measurement value through PID control, and a learning controller configured to learn the fuel correction quantity in a learning map by a histogram of oriented gradient and to determine a learning value as an output value corresponding to the fuel correction quantity by a bilinear interpolation to output the output value for a next fuel injection quantity, and the engine ECU to control the engine by performing feedback control of the output value of the system for controlling a fuel injection quantity for a next fuel injection quantity.

Various aspects of the present invention are directed to providing**

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1A:
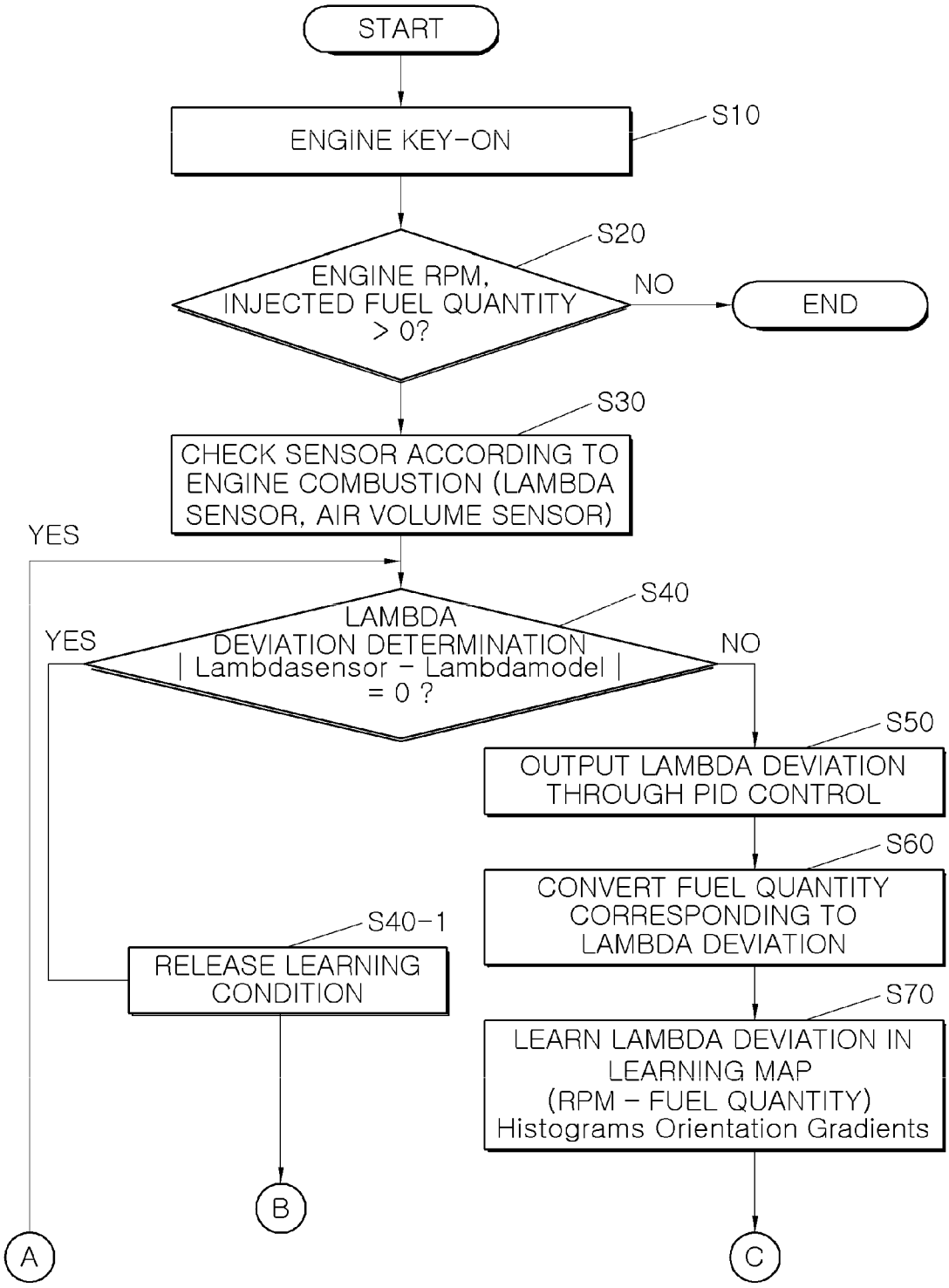
FIG. 1A and FIG. 1B are a flowchart illustrating a method of controlling a fuel injection quantity using a lambda sensor according to an embodiment of the present invention.

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Figure 1B:
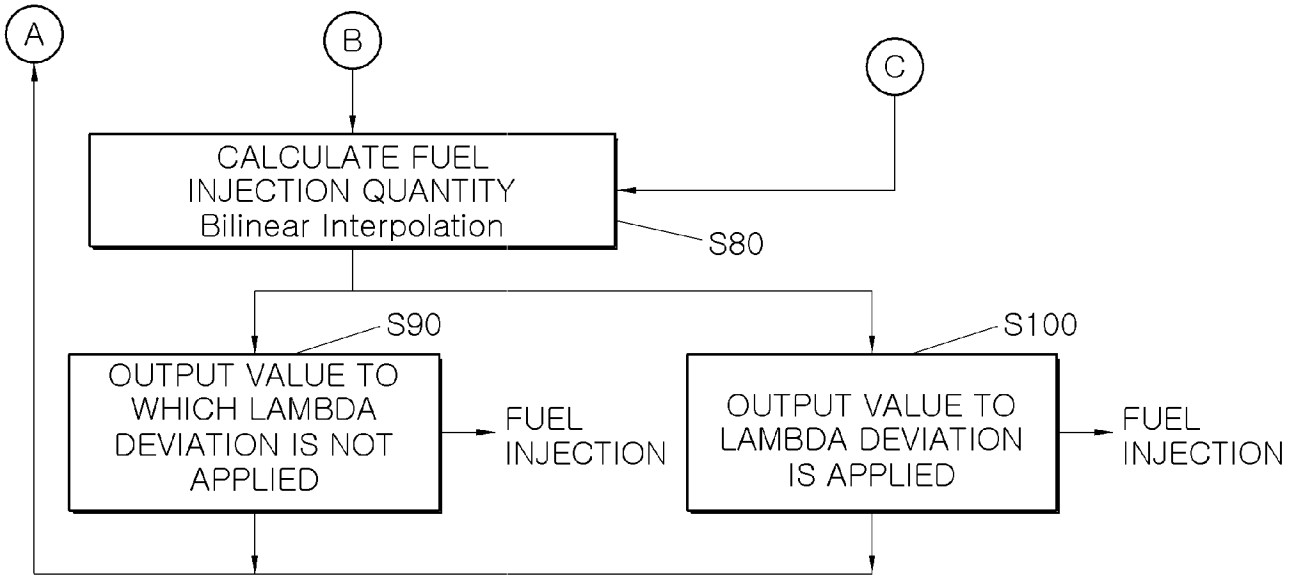

Referring to FIG. 1A and FIG. 1B, in a method of controlling a fuel injection quantity using a lambda sensor, a lambda deviation, which reflects a surrounding environmental error and a service error as well as a sensor itself, is determined by comparing the value measured by a lambda sensor of an exhaust system with a lambda model forming the engine combustion model (S40), a fuel correction quantity corresponding to the lambda deviation is learned in an RPM (Revolutions Per Minute) and fuel quantity learning map by a histogram of oriented gradient and the learning map is updated (S70), and a fuel injection quantity is determined depending on an RPM and a fuel quantity in an operating section or condition, based on the updated learning map in which the fuel correction quantity corresponding to the lambda deviation is learned by a bilinear interpolation (S80). Here, the histogram of oriented gradient is a type of feature descriptor which more facilitates classification by generalizing identical objects to one object as far as possible even though they are present in slightly different states (forms).

Therefore, it is possible to improve or perfectly resolve the deterioration of power and fuel efficiency and the increase of exhaust harmful gas, which are caused by to difference between the determined fuel injection quantity and the actual fuel injection quantity, by establishing the hardware robustness of an air volume sensor and a lambda sensor affected by engine durability as well as manufacturing deviations and service errors. Since the fuel correction quantity corresponding to the lambda deviation is feedback controlled in the next injection, the existing learning value is added and subtracted according to the operating section or condition and thus the learning map is consistently updated.

Figure 2:
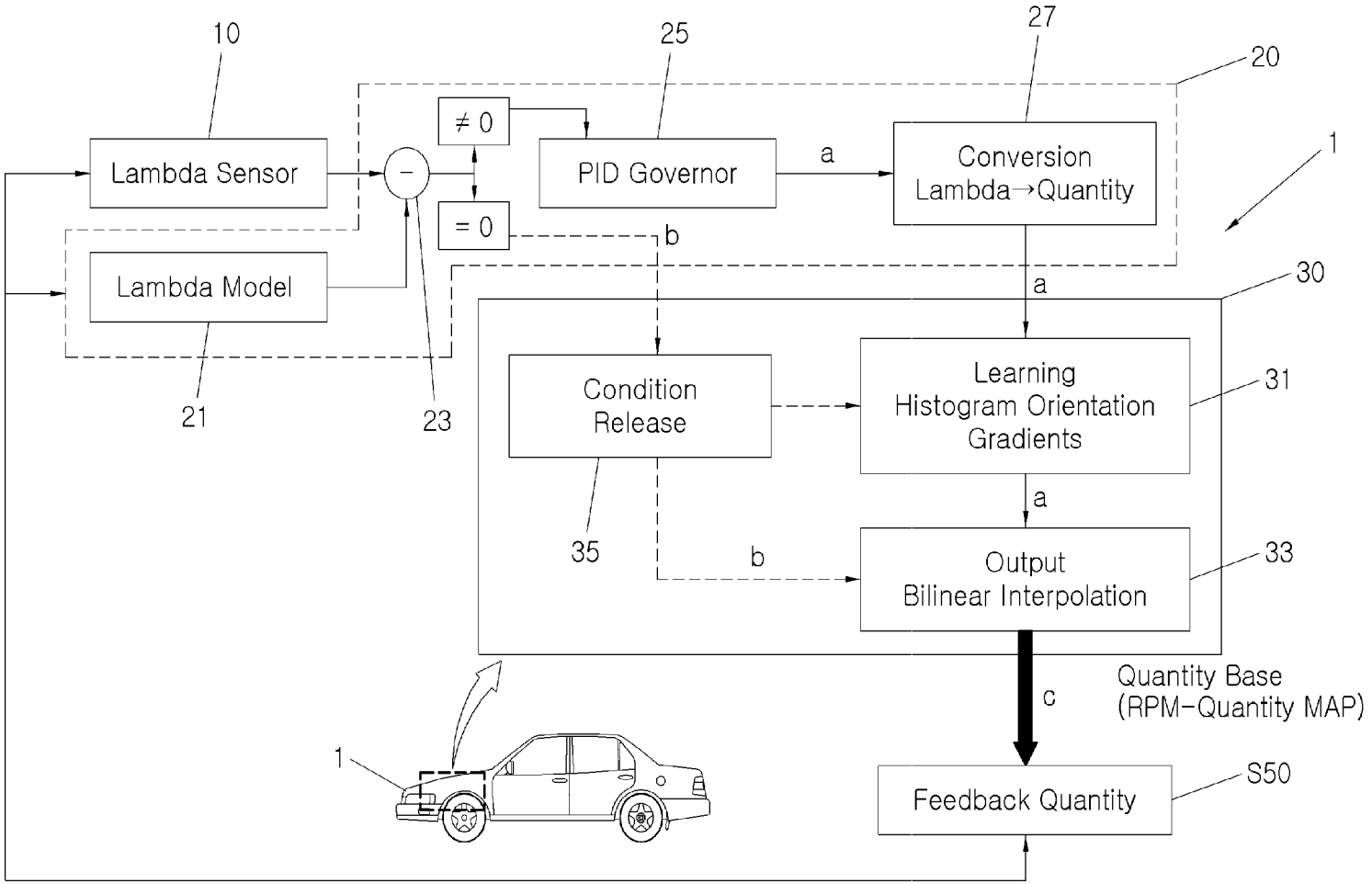
FIG. 2 is an example of a vehicle to which the method of controlling a fuel injection quantity using a lambda sensor according to the embodiment of the present invention is applied.

FIG. 2 illustrates a system for controlling a fuel injection quantity 1 included in the vehicle 100 to perform a lambda deviation learning function. The system for controlling a fuel injection quantity 1 includes a sensor measurement unit 10 which detects a value measured by a lambda sensor, a lambda deviation determination unit 20 which checks a deviation for the measured value of the lambda sensor, and learning controllers 30 and 40 which control an output value by correcting a fuel injection quantity using the lambda deviation.

Specifically, the sensor measurement unit 10 may be connected to an exhaust lambda sensor provided in an exhaust system, or may be an exhaust lambda sensor itself.

Specifically, the lambda deviation determination unit 20 includes a lambda model 21 forming the engine combustion model made by mapping the measured value of the lambda sensor according to the engine operating condition, a subtractor 23 which obtains a lambda deviation using the difference between sensor measurement values, a PID governor which outputs a lambda deviation value by Proportional Integral Differential (PID) control, and a convertor 27 which converts the lambda deviation value output through the PID control into a fuel injection quantity corresponding thereto.

Specifically, the learning controllers 30 and 40 include a learning map 30 and an engine ECU (Electronic Control Unit) 40. The learning map 30 includes a learning machine 31 in which an RPM-fuel quantity is predefined according to an operating section or condition, when the fuel correction value by the lambda deviation is input to one point, four points surrounding the one point form a bin cell 30-1 (see FIG. 4) and each have a bin value, and lambda deviations for the four points of the bin cell 30-1 are learned and updated by a histogram of oriented gradient, a calculator 33 which generates one output for the one point surrounded by the four points of the bin cell 30-1 by a bilinear interpolation using the fuel correction value by the lambda deviation and determines a fuel injection quantity reflecting the lambda deviation, and a condition release machine 37 which releases the application condition of the lambda deviation. The engine ECU 40 applies the output value of the learning map 30 to fuel injection control, and implements control logic such that the output value is used for feedback control in the next injection, and controls an engine by treating all types of data required to control the engine as input values. The engine ECU 40 may be integrated with the learning map 30.

Hereinafter, the method of controlling a fuel injection quantity using a lambda sensor will be described in detail with reference to FIGS. 2 to 5. In this case, a control performer is the engine ECU 40 connected to the learning map 30, and the learning map 30 and the engine ECU 40 are referred to as a "controller" for convenience of description since they may be replaced with dedicated controllers as occasion demands. A subject to be controlled may be a fuel injection quantity or a fuel injection device (e.g. a fuel injector).

S10 is a step in which the controller detects engine key-on. S20 is a step in which the controller checks an engine RPM and a fuel injection quantity in the key-on state. To this end, the controller determines whether engine combustion is performed by recognizing the engine ignition based on a key-on signal, and by checking the engine RPM and the fuel injection quantity based on signals detected by various sensors (e.g. an engine RPM sensor, and a fuel injection quantity sensor) mounted in the engine.

For example, the controller uses the following relationship to determine engine combustion:

Engine combustion=Engine RPM and Fuel injection quantity>0, where the symbol ">" is an inequality sign.

As a result, since the engine combustion is not performed when the engine RPM and the fuel injection quantity are not greater than "0" in the state of engine key-on, the controller stops the process of controlling the fuel injection quantity using hardware error correction. On the other hand, since the engine combustion is performed when the engine RPM and the fuel injection quantity are greater than "0" in the state of engine key-on, the process proceeds to S30 and the controller begins the process of controlling the fuel injection quantity using hardware error correction.

S30 is a step in which the controller checks a sensor detection value. In this step, the controller considers only values detected by the lambda sensor and the air volume sensor among various sensor detection values. This is because the values detected by the lambda sensor and the air volume sensor are highly affected by manufacturing deviations, service errors, and engine durability. Here, the lambda sensor is mounted in the exhaust system, and the air volume sensor is mounted in the intake system.

S40 is a step in which the controller determines whether the value detected by the lambda sensor is accurate. To this end, the controller uses the following relationship for lambda deviation determination, $$\text{Lambda deviation determination, } |\text{Lambda}_{sensor} - \text{Lambda}_{model}| = 0,$$

where the term "$\text{Lambda}_{sensor}$" is a lambda sensor detection value, the term "$\text{Lambda}_{model}$" is a lambda sensor modeling value, the symbol "H" is an absolute value sign, the symbol "–" is a subtraction sign, and the symbol "=" is an equality sign.

Referring to FIG. 2, the lambda deviation is determined by the subtractor 23, based on a difference value obtained by subtracting the lambda model set value of the lambda model 21 from the lambda sensor measurement value of the exhaust lambda sensor measurement unit 10. Here, a lambda deviation learning mode is when the difference value is present (i.e. the difference of two values≠0), a lambda deviation non-learning mode is when the difference value is not present (i.e. the difference of two values=0).

Specifically, in the lambda deviation learning mode, after the lambda deviation is converted into a fuel quantity by the converter 27 via the PID governor 25, the lambda deviation fuel quantity in the converter 27 is learned and updated by the learning machine 31, and is then determined as a fuel injection quantity by the calculator 33. Next, the lambda deviation fuel quantity is output through the engine ECU 40 (direction of the arrow a). Since the lambda deviation is output through the PID control of the PID governor 25, it is possible to minimize the lambda deviation. The learning machine 31 learns the lambda deviation according to the operating section, based on the RPM and fuel quantity map, and then updates the learning value stored in the map. To this end, the learning machine 31 uses a histogram of oriented gradient changed to a two-dimensional histogram interpolation. In addition, the calculator 33 determines the fuel injection quantity by the bilinear interpolation using the lambda deviation fuel quantity learned by the learning machine 31 as input data. Meanwhile, in the lambda deviation non-learning mode, the lambda deviation is determined as a fuel injection quantity by the calculator 33 without via the learning machine 31 by the condition release machine 37 (direction of the arrow b), and is then output through the engine ECU 40 (direction of the arrow c). To this end, the calculator 33 determines the fuel injection quantity by the bilinear interpolation using the fuel quantity depending on the lambda sensor measurement value as input data.

Figure 3:
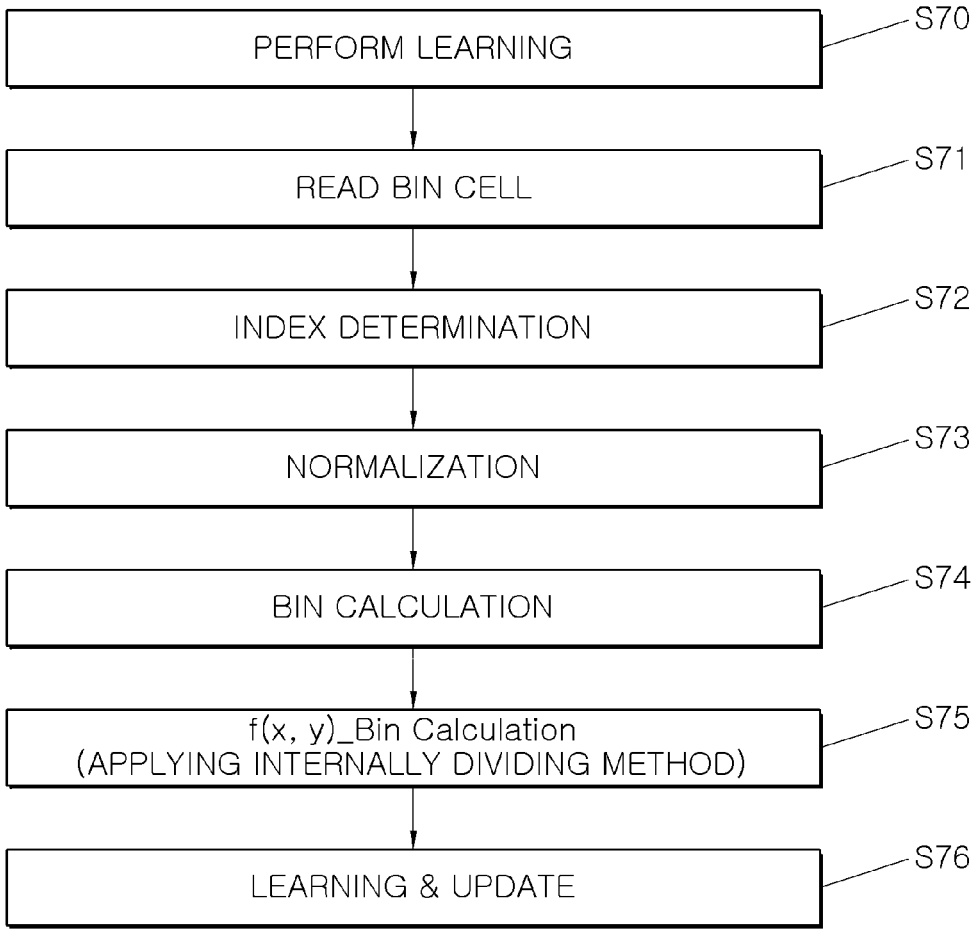
FIG. 3 is a flowchart illustrating lambda deviation learning performed by a histogram of oriented gradient according to the embodiment of the present invention.

Referring to FIG. 1A and FIG. 1B again, in the lambda deviation learning mode, a step of outputting a lambda deviation through PID control (S50), a step of converting a fuel quantity corresponding to the lambda deviation (S60), a step of learning the lambda deviation in a learning map (S70), a step of determining a fuel injection quantity (S80), and a step of outputting a value to which the lambda deviation is applied (S100) are sequentially performed. Accordingly, the fuel injection quantity, which is determined in consideration of the fuel correction quantity by the lambda deviation, is given as an fuel injection quantity. Referring to FIG. 3, in the lambda deviation learning mode, the lambda deviation is learned by a step in which the bin cell in an associated operating section is determined as four points surrounding one point in the learning map (S71), a step of determining an index from the determined bin cell (S72), a step of performing normalization using the index (S73), a step of determining bins for the four points through the normalization (S74), a step of determining a bin function (f(x, y)_bin) by applying an internally dividing method to the determined four bins (S75), and a step in which the bin values of the four points are learned and updated to update the learning map (S76).

Figure 4:
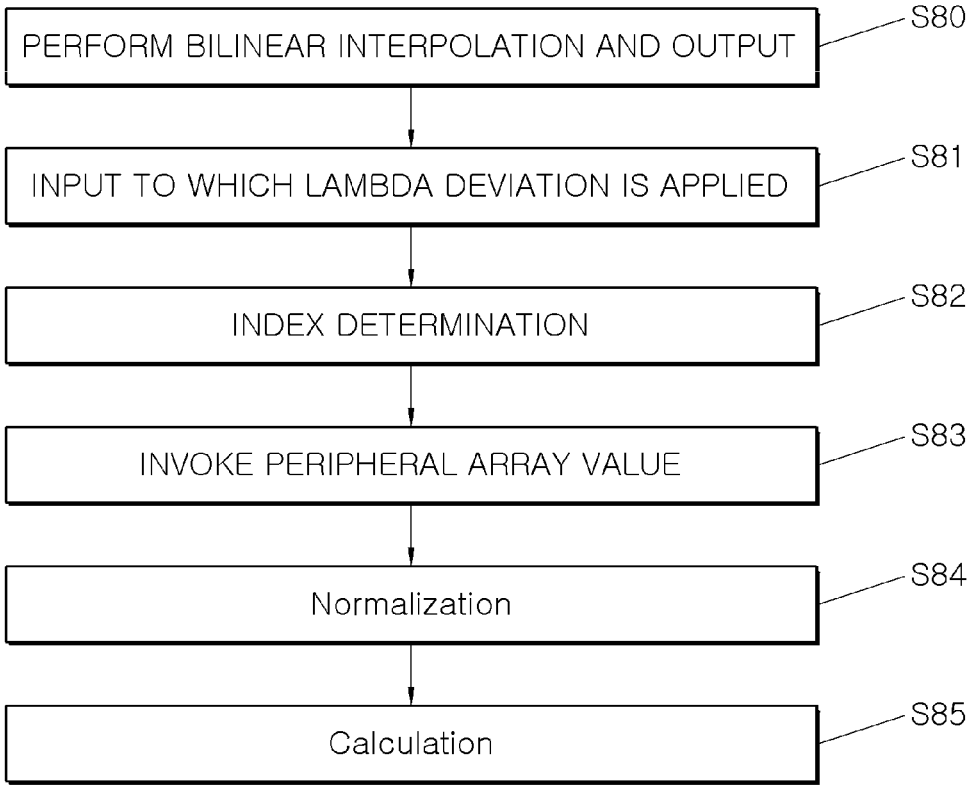
FIG. 4 is a flowchart illustrating fuel injection quantity calculation performed by a bilinear interpolation according to the embodiment of the present invention.

Referring to FIG. 4, in the lambda deviation learning mode, the lambda deviation fuel injection quantity is determined by a step in which the RPM and fuel quantity in the operating section or condition are provided as input to which the lambda deviation is applied, based on the updated learning map (S81), a step of determining an index for the input (S82), a step of invoking a peripheral array value (S83), a normalization step (S84), and a determination step (S85).

Referring to FIG. 1A and FIG. 1B again, in the lambda deviation non-learning mode, a step of releasing a learning condition (S40-1), a step of determining a fuel injection quantity (S80), and a step of outputting a value to which the lambda deviation is not applied are sequentially performed. Accordingly, the fuel injection quantity, which is determined using the lambda sensor measurement value, is given as an fuel injection quantity. Therefore, the lambda deviation non-learning mode differs from the lambda deviation learning mode in that, in step S81, the lambda sensor measurement value is used instead of the learning value in the updated learning map, and steps S82, S83, S84, and S85 are performed. That is, the difference between the lambda deviation learning mode differs from the lambda deviation non-learning mode is that the lambda sensor measurement value to which the lambda deviation is applied is used, or otherwise only the lambda sensor measurement value is used, when determining a fuel injection quantity.

Figure 5:
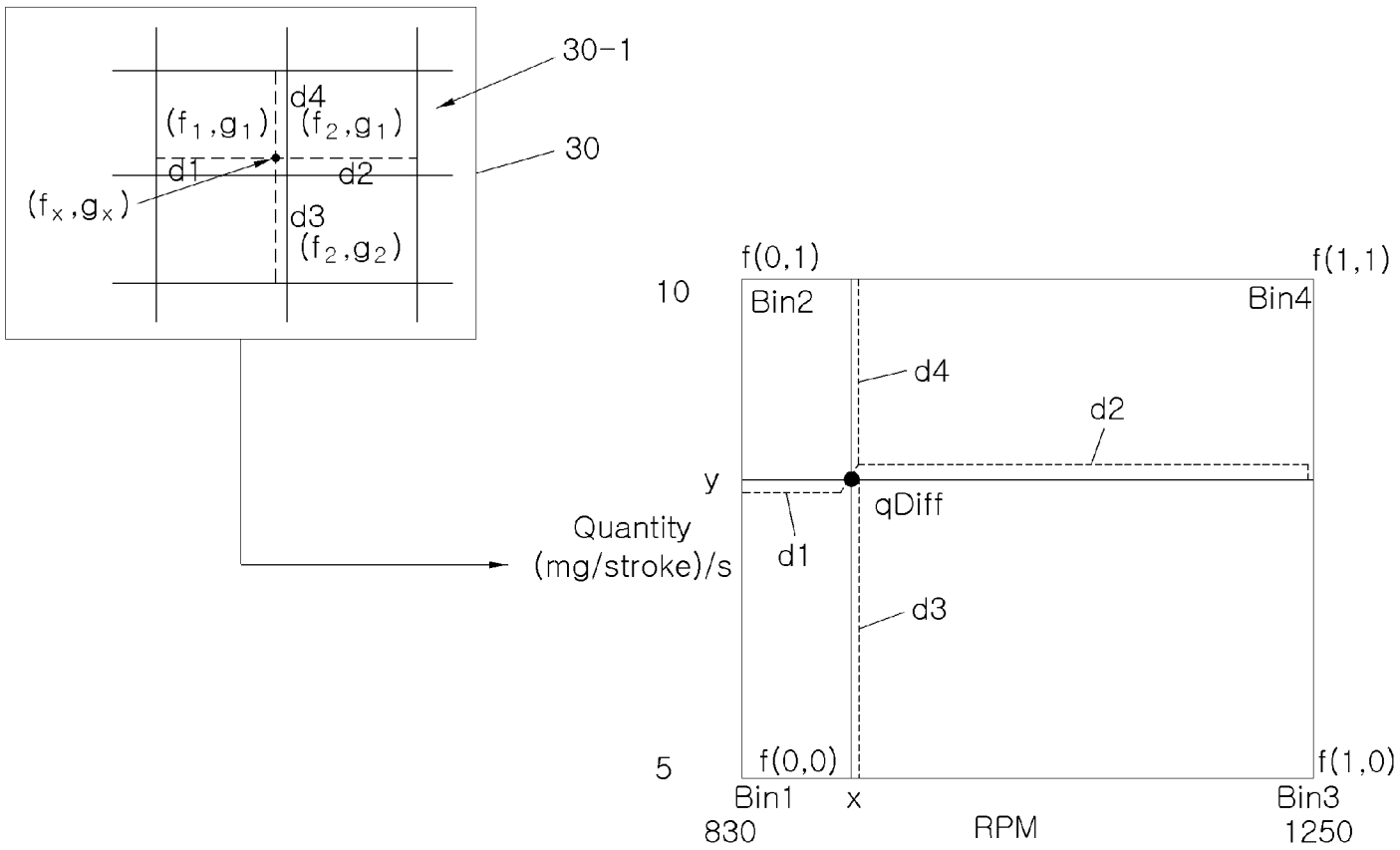
FIG. 5 is an example of the histogram of oriented gradient and the bilinear interpolation applied for the lambda deviation learning and the power calculation according to the embodiment of the present invention.

Meanwhile, FIG. 5 illustrates an example of the lambda deviation learning in FIG. 3 and the lambda deviation fuel quantity determination in FIG. 4, which are applied by changing a histogram of oriented gradient to a two-dimensional histogram interpolation.

As illustrated in the drawing, a three-dimensional (3D) histogram of oriented gradient is used to prevent aliasing from occurring in image extraction. Here, the aliasing is a signal distortion phenomenon in which, when an analog signal is sampled, the sampling frequency is two times smaller than the maximum frequency of a signal or the filtering thereof is inappropriate, and for this reason, adjacent spectra overlap with each other.

Accordingly, the widely known equation of 3D histogram of oriented gradient is as follows, $$h(x1,y1,z1)\leftarrow h(x1,y1,z1)+w\{[1-((x-x1)/b_x)][1-((y-y1)/b_y)][1-((z-z1)/b_z)]\}$$

$$h(x1,y1,z2)h(x1,y1,z2)+w\{[1-((x-x1)/b_x)][1-((y-y1)/b_y)][(z-z1)/b_z]\}$$

$$h(x1,y2,z1)h(x1,y2,z1)+w\{[1-((x-x1)/b_x)][(y-y1)/b_y][1-((z-z1)/b_z)]\}$$

$$h(x2,y1,z1)\leftarrow h(x2,y1,z1)+w\{[((x-x1)/b_x][1-((y-y1)/b_y)][1-((z-z1)/b_z]\}$$

$$h(x1,y2,z2)h(x1,y2,z2)+w\{[1-((x-x1)/b_x)][(y-y1)/b_y][(z-z1)/b_z]\}$$

$$h(x2,y1,z2)h(x2,y1,z2)+w\{[(x-x1)/b_x][(1-((y-y1)/b_y)][(z-z1)/b_z]\}$$

$$h(x1,y2,z1)h(x2,y2,z1)+w\{[(x-x1)/b_x][(y-y1)/b_y][(1-(z-z1)/b_z]\}$$

$$h(x2,y2,z2)h(x2,y2,z2)+w\{[(x-x1)/b_x][(y-y1)/b_y][(z-z1)/b_z]\},$$

where w is a factor of the 3D histogram of oriented gradient equation.

Accordingly, the bin cell 30-1 of the learning map 30 for one input data in the operating section is indicated as four adjacent bin values obtained by addition and subtraction using the bilinear interpolation, and this is expressed by the following 2D histogram interpolation equation, $$F(f_1,g_1)=F(f_1,g_1)+w[(d2/(d1+d2))\times(d4/(d3+d4))]$$

$$F(f_1,g_2)=F(f_1,g_2)+w[(d2/(d1+d2))\times(d3/(d3+d4))]$$

$$F(f_2,g_1)=F(f_2,g_1)+w[(d1/(d1+d2))\times(d4/(d3+d4))]$$

$$F(f_2,g_2)=F(f_2,g_2)+w[(d1/(d1+d2))\times(d3/(d3+d4))]$$

Where $(f_x, g_x)$ is a two-dimensional coordinate position of one input data, d1, d2, d3, and d4 are respective four bin cell distances for $(f_x, g_x)$, and $(f_1, g_1)$, $g_2)$, $(f_2, g_1)$, and $(f_2, g_2)$ are respective two-dimensional coordinate positions of four bin cells for $(f_x, g_x)$.

Therefore, the lambda deviation learning process in FIG. 3 may be performed as follows.

In the step of reading a bin cell (S71), the lambda deviation fuel quantity of the learning machine 31 is provided as one input data, and qDiff is determined by the coordinate function $F(f_x, g_x)$ of the bin cell 30-1 having four adjacent bin values.

In the index determination step (S72), the section in which the qDiff is present is determined. In the normalization step (S73), the normalization is performed by setting the RPM and fuel quantity in the determined section as size 1. For example, it is treated as d1+d2=1 and d3+d4=1. In the bin determination step (S74), the four bins of the bin cell 30-1 are respectively defined as a first bin (Bin 1: d2×d4), a second bin (Bin 2: d2×d3), a third bin (Bin 3: d1×d4), and a fourth bin (Bin 4, d1×d3). In the step of determining a bin function (f(x, y)_Bin) by applying the internally dividing method (S75), w (Factor) is determined using the following equation, $$f(x,0)_bin=Bin1\times d2+Bin3\times d1, f(x,1)_bin=Bin2\times d2+Bin4\times d1, f(x,y)_Bin=f(x,0)_bin\times d4+f(x,1)_bin\times d3, f(x,y)_Bin=q\mathrm{Diff}=Bin(i), x, w=q\mathrm{Diff}/f(x,y)_Bin.$$

Next, in the learning and update step (S76), the equation for learning is as follows. In this case, in $F(f_1,g_1)$_new=$F(f_1,g_1)$_old+w[(d2/(d1+d2))×(d4/(d3+d4))], it is treated as $F(f_1,g_1)$_old=0 in initial learning.

$$f(0,0)_new=f(0,0)_old+(q\mathrm{Diff}\times Bin1)/f(x,y)_Bin$$

$$f(0,1)_new=f(0,1)_old+(q\mathrm{Diff}\times Bin2)/f(x,y)_Bin$$

$$f(1,0)_new=f(1,0)_old+(q\mathrm{Diff}\times Bin3)/f(x,y)_Bin$$

$$f(1,1)_new=f(1,1)_old+(q\mathrm{Diff}\times Bin4)/f(x,y)_Bin$$

The lambda deviation fuel quantity determination in FIG. 4 may be performed as follows.

In the step of input to which the lambda deviation is applied (S81), the coordinate function $F(f_1, g_1)$_new learned by the learning machine 31 is provided as input data. In this case, the $F(f_1,g_1)$_new is expressed as F(x, y)=f(x, y)=f(1, 0)(1−x)(1−y)+f(1, 0)×(1−y)+f(0, 1)(1−x)y+f(1, 1)xy. Therefore, the updated learning map is used.

In the index determination step (S82), the operating section in which the RPM and the fuel quantity are present is determined using the learning map. To this end, the operating section is divided into sections by setting the RPM of the learning map as an x-axis and setting the fuel quantity (Q) as a y-axis, and an index is designated for each section. For example, assuming that the x (RPM) index-axis is divided into 830, 1250, 1500, 1700, 2100, 2400, and 3000, they (Q) (cc) index-axis is divided into 5, 10, 15, 20, 26, 35, and 40, the RPM is 890, the fuel quantity (Q) is 6.5 cc, and the input data is f(0, 0)=−0.1, f(1, 0)=−0.02, f(0, 1)=−0.01, and f(1, 1)=−0.01, 830<RPM<890 may be set as Index 1 and 5<Q<10 may be set as Index 1.

Next, in a step of invoking a peripheral array value (S83), the above f(0, 0)=−0.1, f(1, 0)=−0.02, f(0, 1)=−0.01, and f(1, 1)=−0.01 are set as four bin values of the bin cell 30-1. In the normalization step (S84), the normalization is performed by setting the invoked peripheral array value as size 1.

For example, the normalization is performed by x_normal: (890−830)/(1250−830)=0.1428 and y_normal: (6.5−5)/(10−5)=0.3333. Here, d1 is 830 RPM, d2 is 1250 RPM, d3 is 5 Q, and d4 is 10 Q. In the determination step (S85), x_norma and y_normal are respectively set as x and y, and they are applied to f(x, y)=f(1, 0)(1−x)(1−y)+f(1, 0)×(1−y)+f(0, 1)(1−x)y+f(1, 1)xy. As a result, the determined value is f(0.1428, 0.3333)=f(1, 0)(1−0.1428)(1−0.3333)+f(1, 0)0.1428(1−0.3333)+f(0, 1)(1−0.1428)0.3333+f(1, 1)0.1428*0.3333. Here, the symbol "*" is a multiplication sign.

Meanwhile, referring to FIGS. 1A, 1B and 2 again, the engine ECU 40 sets the output value to which the lambda deviation is not applied (there is no fuel correction quantity) or the output value to which the lambda deviation is applied (there is a fuel correction quantity) as a fuel injection quantity control value, and the fuel injection quantity control value is used for feedback control in the next injection.

As described above, the method of controlling a fuel injection quantity using a lambda sensor according to the embodiment of the present invention is performed by the step of obtaining a lambda deviation depending on the difference between the exhaust lambda sensor value and the lambda model value after the engine combustion, the step of converting the lambda deviation output through PID control into a fuel quantity and obtaining a lambda deviation correction value, the step of inputting the lambda deviation correction value to one point of the predefined RPM-fuel quantity learning map and obtaining a bin cell divided into four bins surrounding the one point, the step of updating respective learning values obtained by the four points of the bin cell, selecting the section of the RPM and fuel quantity selected depending on the operating condition as a new bin cell, outputting one value from one point surrounded by the four points of the new bin cell, and using the one value for feedback control in the next injection. As a result, the determined fuel injection quantity coincides with an fuel injection quantity, and it is possible to establish robustness against surrounding environmental errors and service errors by consistently learning the fuel injection quantity since the determined fuel injection quantity is output and is then feedback controlled in the next injection.

In accordance with a method of controlling a fuel injection quantity of the present invention, a determined fuel injection quantity can coincide with an actual fuel injection quantity by correcting a value measured by a lambda sensor using a lambda model forming the engine combustion model.

In addition, the method of controlling a fuel injection quantity of the present invention can establish robustness against the influence due to engine durability as well as the manufacturing deviation and service error of a lambda sensor and an air volume sensor by correcting the deviation of the lambda sensor using the lambda model.

In addition, the method of controlling a fuel injection quantity of the present invention can remove exhaust harmful substances or improve power and fuel efficiency by allowing the actual fuel injection quantity to coincide with the determined fuel injection quantity.

In addition, the method of controlling a fuel injection quantity of the present invention can correspond to surrounding environmental errors and service errors by adding and subtracting a learning value depending on operating conditions by the feedback control of output values and by updating the learning value.

In addition, since the method of controlling a fuel injection quantity of the present invention removes exhaust harmful substances or improves power and fuel efficiency, it can exhibit an effect in a diesel engine vehicle.

While the present invention has been described with respect to the specific embodiments, it will be apparent to those skilled in the art that various changes and modifications may be made without departing from the spirit and scope of the invention as defined in the following claims.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures. The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of controlling a fuel injection quantity using a lambda sensor, comprising:

performing a lambda deviation learning mode by controlling a lambda deviation, due to a difference between a lambda model value and a lambda sensor measurement value, by a controller during engine combustion in which an engine RPM and a fuel injection quantity are detected, wherein, in the lambda deviation learning mode, a learning map is learned and is then updated by setting a fuel correction quantity depending on the lambda deviation as a learning value, and the fuel injection quantity is determined, in consideration of the fuel correction quantity depending on an engine RPM and a fuel quantity based on the updated learning map, and is output as an output value, so that the output value is applied to feedback control for a next fuel injection quantity, wherein when the lambda deviation is not generated, a lambda deviation non-learning mode is performed by control of the controller, and in the lambda deviation non-learning mode, the fuel injection quantity is determined, in consideration of the lambda sensor measurement value depending on an engine RPM and a fuel quantity based on the learning map, and is output as the output value, so that the output value is applied to feedback control for the next fuel injection quantity, and wherein the lambda deviation learning mode is performed by converting the lambda deviation output through Proportional Integral Differential (PID) control into the fuel correction quantity, by learning the lambda deviation such that a bin cell is divided into four points surrounding one point, to which the fuel correction quantity is input, by a histogram of oriented gradient in the learning map, and bin values of the four divided points are determined as two-dimensional coordinate values to update the learning map, and by determining a lambda deviation fuel injection quantity such that the bin values of the four points of the bin cell are obtained as two-dimensional coordinate values according to an operating section by a bilinear interpolation in the updated learning map, and one point surrounded by the four points is output as the output value.

2. The method of claim 1, wherein the lambda deviation is present when the difference obtained by subtracting the lambda model value from the lambda sensor measurement value is greater than zero.

3. The method of claim 1, wherein the learning the lambda deviation is performed by determining an index such that an associated section of the learning map, in which the one point is present, is determined, by performing normalization for an engine RPM and a fuel quantity in the associated section, by determining a bin value of each of the four points, by calculating a bin function to which the bin value of each of the four points is applied, and by learning and updating the learning map using a determined value of the bin function.

4. The method of claim 3, wherein the normalization is performed such that the index is set as 1.

5. The method of claim 3, wherein the bin function is determined by applying an internally dividing method thereto.

6. The method of claim 1, wherein the determining a lambda deviation fuel injection quantity is performed by determining an index such that the index is divided into an RPM index and a fuel quantity index to determine whether the bin cell, to which a bin value of each of the four points is input, is present in which of RPM and fuel quantity sections of the learning map, by invoking the bin value of each of the four points as a peripheral array value, by performing normalization such that the RPM index and the fuel quantity index are converted into a reference RPM index and a reference fuel quantity index, and by performing determination such that a value of the one point is obtained as the output value by applying the reference RPM index and the reference fuel quantity index to the four points.

7. The method of claim 6, wherein the normalization is performed such that the index is set as 1.

8. A vehicle comprising:

a system for controlling a fuel injection quantity comprising a sensor measurement unit configured to detect a measured value of a lambda sensor, a lambda deviation calculation unit configured to determine a lambda deviation by comparing the lambda sensor measurement value with a lambda model value and to determine a fuel correction quantity by outputting the determined lambda deviation through Proportional Integral Differential (PID) control, and a learning controller configured to learn a revolution per minute (RPM) and a fuel quantity using the fuel correction quantity by a histogram of oriented gradient, to determine a learning value as an output value corresponding to the fuel correction quantity by a bilinear interpolation depending on the RPM and a fuel quantity in an operating section to which the learning value is applied, and then to apply the output value to feedback control for a next fuel injection quantity.

9. The vehicle of claim 8, wherein the lambda sensor is provided in an exhaust system from which exhaust gas is discharged to an outside.

10. The vehicle of claim 9, wherein the lambda deviation determination unit includes a lambda model in which the lambda model value compared with the lambda sensor measurement value is established, a PID governor to output a lambda deviation value, obtained by subtracting the lambda model value from the lambda sensor measurement value, through the PID control, and a converter to determine the fuel injection quantity output through the PID control.

11. The vehicle of claim 10, wherein the learning controller includes a learning map configured to divide the operating section into an RPM section and a fuel quantity section and to be updated by learning the learning value, and the learning map includes a learning machine to perform the histogram of the oriented gradient and a calculator to perform the bilinear interpolation.

12. The vehicle of claim 9, wherein the system for controlling the fuel injection quantity is connected to an engine control unit (ECU) to control an engine.

13. The vehicle of claim 12, wherein the engine ECU performs feedback control of the output value of the system for controlling the fuel injection quantity for the next fuel injection quantity.

* * * * *